United States Patent [19]

Nielsen

[11] 4,379,529

[45] Apr. 12, 1983

[54] TUBE FOR YARN BOBBIN

[76] Inventor: Hans B. Nielsen, Bühlstrasse 3, CH-8125 Zollikerberg, Switzerland

[21] Appl. No.: 237,149

[22] PCT Filed: May 28, 1980

[86] PCT No.: PCT/DK80/00033

§ 371 Date: Feb. 19, 1981

§ 102(e) Date: Feb. 19, 1981

[87] PCT Pub. No.: WO80/02832

PCT Pub. Date: Dec. 24, 1980

[51] Int. Cl.[3] ..... B65H 75/20

[52] U.S. Cl. ..... 242/118.11; 68/198

[58] Field of Search ..... 242/118.1, 118.11, 118.2, 242/118.3, 118.31, 118.32; 68/189, 198

[56] References Cited

U.S. PATENT DOCUMENTS

| | | | |
|---|---|---|---|
| 2,936,964 | 5/1960 | Tigges | 242/118.1 |
| 3,253,436 | 5/1966 | Soltis | 68/198 |
| 3,759,460 | 9/1973 | Fyan | 242/118.1 |
| 4,176,811 | 12/1979 | Becker et al. | 242/118.1 |

FOREIGN PATENT DOCUMENTS

| | | | |
|---|---|---|---|
| 1416340 | 9/1965 | France | 242/118.1 |
| 1492546 | 7/1967 | France | 242/118.1 |
| 2363363 | 8/1974 | United Kingdom | 68/198 |

*Primary Examiner*—Leonard D. Christian

*Attorney, Agent, or Firm*—Cushman, Darby & Cushman

[57] ABSTRACT

A tube for yarn bobbins of a moulded plastic material which may be axially compressed, said tube being composed of a number of connected concentric rings (2), where the two end rings (1 and 3) are differently shaped with inner and outer cylindrical surfaces (4 and 6) or conical surfaces adapted to each other, said surfaces providing a seal, and where the cylindrical or conical surface is formed by arms (9) extending from the rings along generatrixes, and the rings are connected with strings (11) shaped as springs which when stretched extend substantially parallel to the generatrixes but which are located under the cylindrical or conical surface formed by the arms.

6 Claims, 7 Drawing Figures

TUBE FOR YARN BOBBIN

TECHNICAL FIELD

The present invention relates to a tube for yarn bobbins of the type having variable length in axial direction.

BACKGROUND ART

Tubes for yarn bobbins are devices comprising a perforated cylindrical or frusto-conical surface for retaining the yarn reeled on the tube while said yarn is exposed to a liquid treatment, especially a dyeing with a subsequent drying, in an apparatus in which several tubes are located end to end on perforated distributor pipes through which the treatment liquid is pumped out through the yarn.

The present invention and the prior art will be described below with reference to cylindrical tubes as a conical shape of the tube does not change the problems with which the invention is concerned, viz. the problems arising in connection with the liquid treatment, but which shape is substantially used for the sake of rewinding the yarn.

Tubes for yarn bobbins must especially meet the following three requirements:

1. They must be inexpensive because they are employed in a very high number, which to a single dye-works may be of the magnitude ½ million.
2. They must permit the densest possible filling of yarn bobbins in the dyeing apparatus to minimize the consumption of water and chemicals, especially to avoid pollution of the environment with the waste liquids.
3. They must permit a uniform dyeing and drying of the yarn.

The oldest known tube which is used today is a perforated metal cylinder. Tubes of this type are placed on the distributor pipes with discs between every two tubes and are compressed by means of a cap screwed on the end of the distributor pipe, thus providing a seal between the metal cylinder and the intermediary discs. These tubes provide the most uniform dyeing of yarn, but they have the disadvantage that they are rather expensive and allow only a very bad filling of the space in the dyeing apparatus, partly because the intermediary discs take up room and partly because the tubes do not permit a compression of the yarn bobbins. In fact these tubes permit a filling of the yarn dyeing apparatus which is only well over half of what can be obtained with certain other types of tubes.

Therefore tubes have been produced of variable length in axial direction, so that the yarn bobbin can be compressed. Such a tube may for instance be a compressible metal spiral or two metal cages displaceable relative to each other and locked together with a ring, and which are kept in a stretched position by a helical spring as described in U.S. Pat. No. 2,818,222. This type of tubes permits a good filling of the space in the dyeing apparatus, but is expensive due to the nature of the material since in practice only stainless steel can be used, and such tubes give rise to uneven dyeing.

A second type of tubes of variable length in axial direction is the type disclosed in British Patent specification No. 1,169,962, and it is made of an injection moulded plastic material in which the cylinder surface is formed by a row of concentric rings connected by strings extending obliquely relative to the axial direction and being of such dimensions that the tube may be compressed in the axial direction by virtue of the resilience of the material. These tubes have the advantage to be very inexpensive, but are in practice only disposable tubes because the plastic material undergoes a heat set at the high temperatures used for dyeing and drying, and therefore the tubes are either to be discarded or to be straightened again after every use after being heated in hot-air. Furthermore it is not possible either by the use of these tubes to obtain a desired uniformity of the dyeings.

The cause of the uneven dyeing when using the known tubes of variable length has turned out to be the fact that no efficient seal exists between two adjacent bobbins in spite of the compression thereof. This has the effect that a large part of the circulating amount of dye liquid takes the easier path betwen two bobbins instead of passing through the bobbins. In practice this is a major drawback since the amount of dye liquid passing between the bobbins is uncontrollable. Measurings have shown that at lower temperatures minimum amounts of from 0 to 20% pass, but this only applies as long as the yarn is resilient, whereby the compression of the bobbins assist in forming a seal. As the resilience of the yarn decreases during the influence of heat, the amount of dye liquid passing between two bobbins increases. The mean value of the measurings is 50% dye liquid, and in extreme cases 80 to 90% may be measured. These figures apply to yarn of wool/acryl mixtures at temperatures of 40° to 100° C. When after a completed process yarn and dye liquid are cooled, the yarn bobbins and the fixed tubes shrink, whereby the leaks and consequently the flow losses are increased. A tube, which for instance is fixed in a length of 100 mm at 100° C., shrinks 1.25 mm at cooling to 30° C. Thus after the cooling a space of 1.25 mm is present between two adjacent bobbins. The result is uneven dyeings, especially in cases where after completed dyeing and shade control it is found necessary to cool the dye in order to add more dyestuff. By this shading process large flow losses occur during the entire rise of temperature because the channels in the yarn formed during the first dyeing are permanent and cannot even be removed by an increased compression of the bobbins. The same leaks also exist during the drying when hot air in large amounts is blown through the bobbins. This causes longer drying periods and a heavy loss of energy.

This drawback may be overcome by the two end rings being differently shaped and with such profiles that one end ring presents an outer cylinder or conical surface fitting in an inner cylinder or concical surface on the second ring, and by both rings being provided with an outward radial flange, cf. British Patent specification No. 1,333,608. In this manner a uniform dyeing and drying of yarn is obtained, the seal between the tubes not depending on an axial compression of the tubes end to end, but being established by virtue of the seal between the two cylinder or conical surfaces of the end rings. However, the tube according to British Patent specification No. 1,333,608 is encumbered with the same drawbacks as the tube according to British Patent specification No. 1,169,962, as the strings extending between the concentric rings are the supporting means for the yarn reeled, for which reason they must possess such a strength and thickness that the tube is difficult to restraighten after use due to the heat set of the plastic material. Furthermore, the strings must extend obliquely relative to the axial direction and therefore in a direction substantially parallel to the winding line of the yarn, whereby the inner yarn layer may get jammed at the compression of the tube, which in practice may cause a waste of yarn of 1 to 1.5%.

DISCLOSURE OF INVENTION

The tube according to the present invention is of the type with variable length in axial direction, and which is made of a moulded plastic material and composed of a number of concentric rings and strings extending therebetween and being of such dimensions that the tube may be compressed in axial direction by virtue of the resilience of the material, and where the two end rings are differently shaped and with such profiles that one end ring presents an outer cylinder or conical surface fitting in an inner cylinder or conical surface on the second end ring, and where both end rings are provided with an outward radial flange. The tube according to the invention is characterised in that all the rings are provided with arms extending along generatrixes in the cylindrical or slightly conical surface of the tube and forming said surface, and that the strings connecting the rings are shaped as springs which when stretched extend substantially parallel to the generatrixes but which are located under the cylindrical or conical surface formed by the arms. As a result, the arms constituting the supporting means for the yarn reeled may be given such dimensions that they possess a great rigidity and strength, and the strings having no supporting function are only to hold the end rings and the intermediary rings together and to determine the stretched length of the tube during the reeling process, and may be given such modest dimensions that the loss of resilience on account of the heat set of the plastic material is reduced.

According to the invention is it preferred that the arms two by two on the opposing sides are provided with knobs projecting beyond the centre line between the arms and comprising a surface forming a large angle with the axis of the tube so that they lock the tube in the stretched position when the knobs have passed each other and said surfaces bear against each other.

A particularly advantageous embodiment of the strings is according to the invention characterised in that the strings extend rectilinearly between the rings and have a single S-shaped bend.

BRIEF DESCRIPTION OF DRAWINGS

The invention will be described below with reference to the accompanying drawing, in which.

BEST MODE FOR CARRYING OUT THE INVENTION

Figure 1:
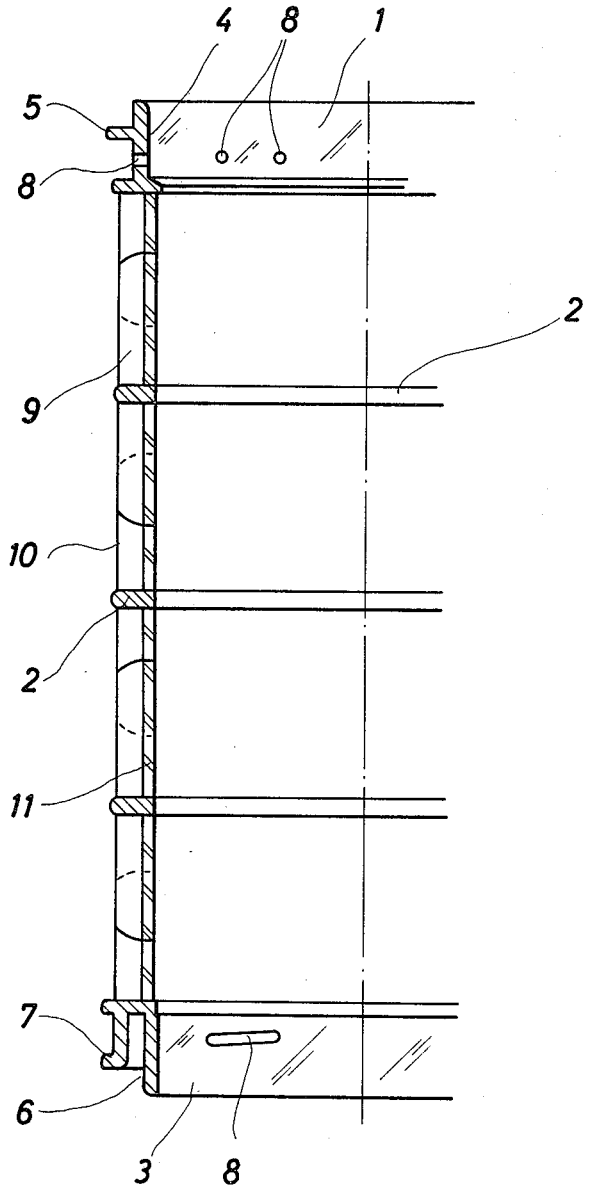
FIG. 1 is an axial sectional view of one half of a tube according to the invention.

FIG. 1 illustrates one end ring 1, intermediary rings 2, and the second end ring 3. The end ring 1 is shaped with an inner cylinder surface 4 and an outward radial flange 5, whereas the end ring 3 is shaped with an outer cylinder surface 6 of the same diameter as the inner cylinder surface 4 and comprising an outward radial flange 7. When the tubes are placed end to end on a distributor pipe in a dyeing apparatus the outer cylinder surface 6 on one tube is pushed into the inner cylinder surface 4 of a second tube, the outward flanges 5 and 7 forming stops for the axial displacement and furthermore limiting means for the yarn when it is reeled on the tube. On account of the seal between the two cylinder surfaces 4 and 6, dye liquid cannot penetrate between the bobbins, and the seal therebetween is thus independent of the pressure used for compressing the bobbins. Even though the bobbins shrink during the cooling, the inner cylinder surface 4 and the outer cylinder surface 6 continue to form a seal and prevent the liquid and the drying air, respectively, from flowing out between the bobbins. The end rings may optionally be provided with perforations 8, so that liquid from the inside may penetrate through the yarn reeled on the tube up to the flanges 5 and 7.

Arms 9 extend from the rings 1, 2, and 3, said arms extending along generatrixes in the cylindrical or slightly conical surface of the tube. The outer side 10 of these arms forms the surface carrying the reeled yarn. The strings connecting the rings are shaped as springs 11, which when stretched, cf. FIG. 2, extend substantially parallel to the generatrixes, but which lie under the cylindrical or conical surface 10 formed by the arms 9 in such a manner that they have no supporting function.

Figure 2:
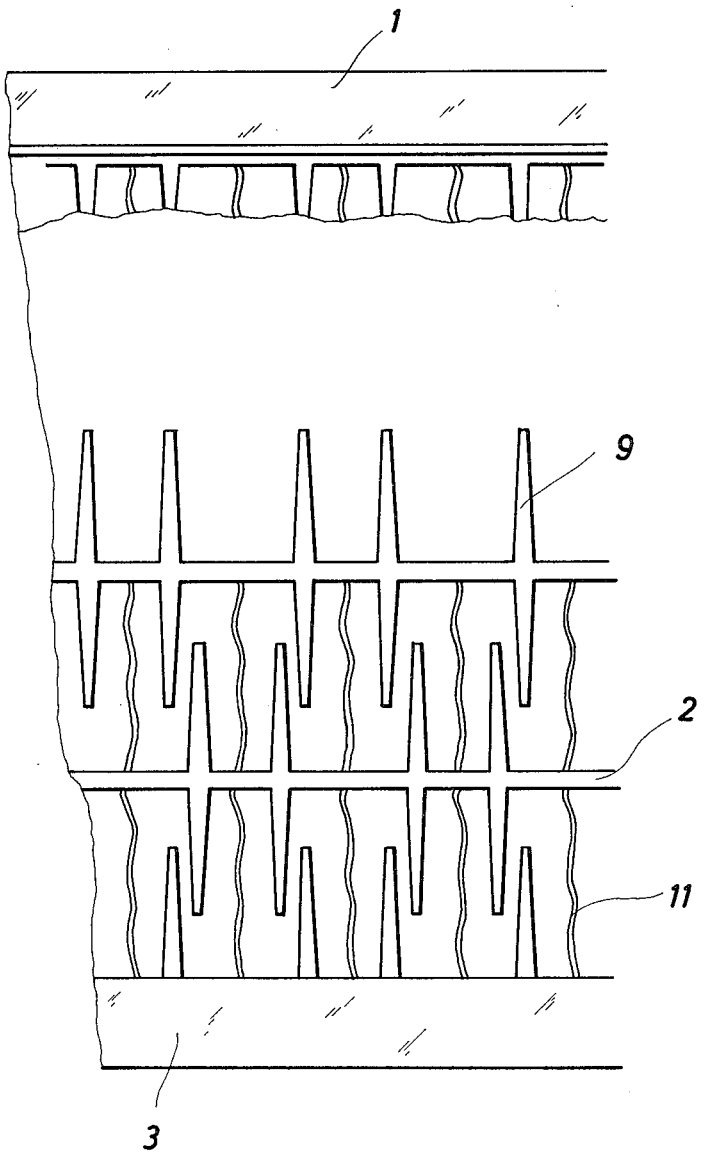
FIG. 2 is a view which illustrates part of the developed cylinder surface of a tube, seen from the inner side of the tube.
Figure 3:
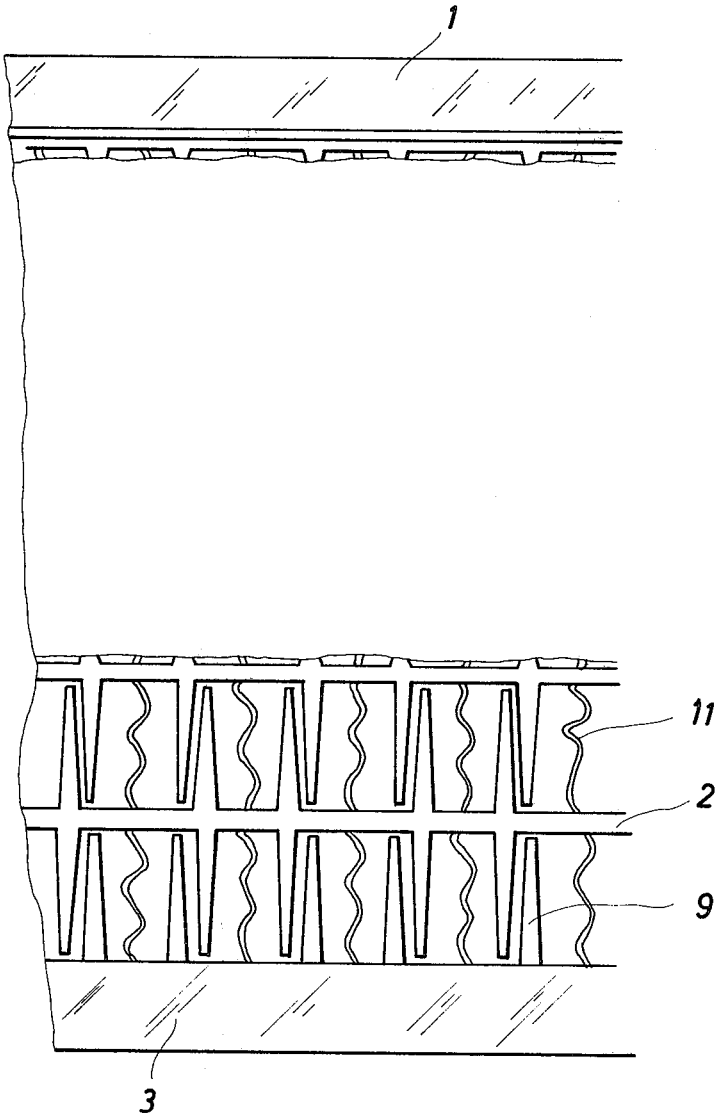
FIG. 3 is a view which illustrates the part of FIG. 2 with the cylinder surface in the compressed state.

The compressed tube is illustrated in FIG. 3. In practice, the tube is moulded in the state illustrated in FIG. 3, i.e. with the springs 11 in the shown huddled zigzag-form. When the tube is stretched the spring does not straighten completely but will take the shape illustrated in FIG. 2. Thus the springs are only stretched in "the cold state", i.e. during the reeling of the yarn and during storage, and they will retain the tendency to take the shape shown in FIG. 4 when the tube is compressed, and in this shape they are exposed to temperatures of up to about 100° C. and cooled as well. The variable length of the tube in axial direction is therefore to a far slighter extent than in the known tubes based on the resilience of the plastic material, and no problem arises in connection with the straightening of the tube after each use.

Figure 4:
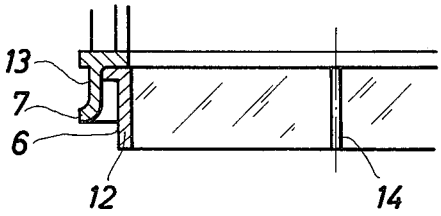
FIG. 4 is a view which illustrates an alternative embodiment of an end ring.

FIG. 4 illustrates an alternative embodiment of one end ring 3. The part 12 of the ring comprising the outer cylinder surface 6 is a separate portion pressed into the part 13 of the ring comprising the outward flange 7. The part 12 is moulded with a slot 14 and with a slightly larger diameter than the diameter of the inner cylinder surface 4, which provides a better possibility of obtaining a tight and close fitting between the surfaces 4 and 6.

Figure 5:
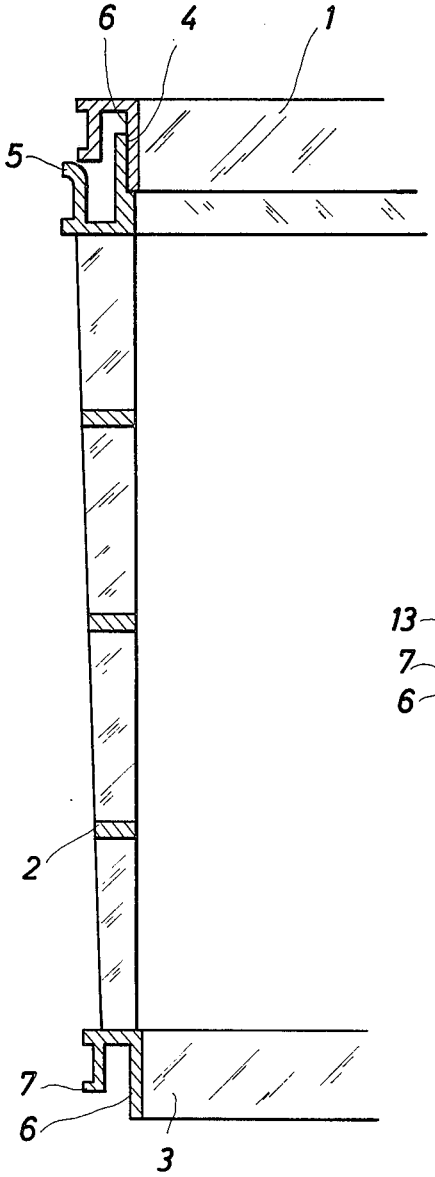
FIG. 5 is a view which illustrates an embodiment of the end rings on a conical tube.

FIG. 5 illustrates an embodiment of the end rings 1 and 3 on a slightly conical tube.

Figure 6:
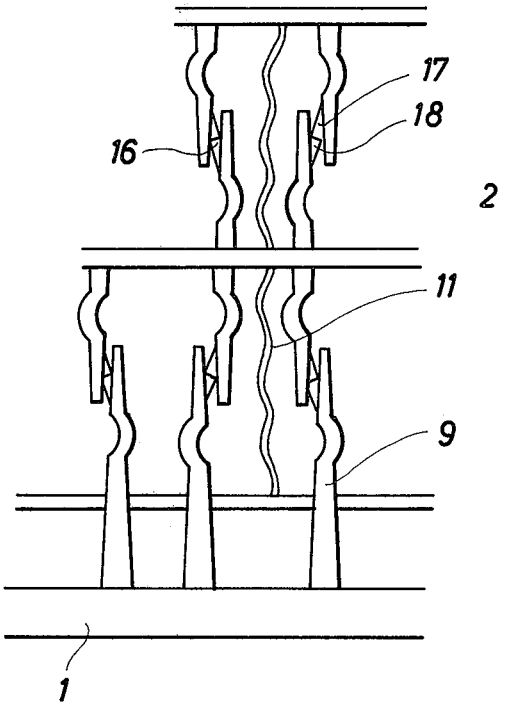
FIG. 6 is a view which illustrates an embodiment of the arms, seen towards the cylinder surface.

FIG. 6 illustrates an embodiment of the arms 9 in which they two by two on the opposing sides are provided with knobs 16 projecting beyond the centre line between the arms. The cross-section of the knobs is triangular. On the sides facing each other these knobs comprise oblique surfaces 17 which form a small angle with the axis of the tube and which when the tube is stretched slide past each other, the resilience of the arms permitting a slight bend. When the knobs have passed each other the arms curve back into the neutral position, and knob surfaces 18 forming a larger angle with the axis of the tube then bear against each other and maintain the tube in the stretched position. In this stretched position the tubes are arranged in the reeling machine. A second possibility of maintaining the tubes stretched on the reeling machine is to provide the end rings with inner projections engaging annular grooves on the mandrel of the reeling machine located with a mutual distance corresponding to a desired height of bobbin, e.g. also a height corresponding to a completely stretched tube. When the tubes illustrated in FIG. 6 have been placed on the distributor pipes in the dyeing apparatus they are exposed to an axial compression which causes the knobs 16 to leap past each other in such a manner that the tubes may be compressed to the desired degree.

Figure 7:
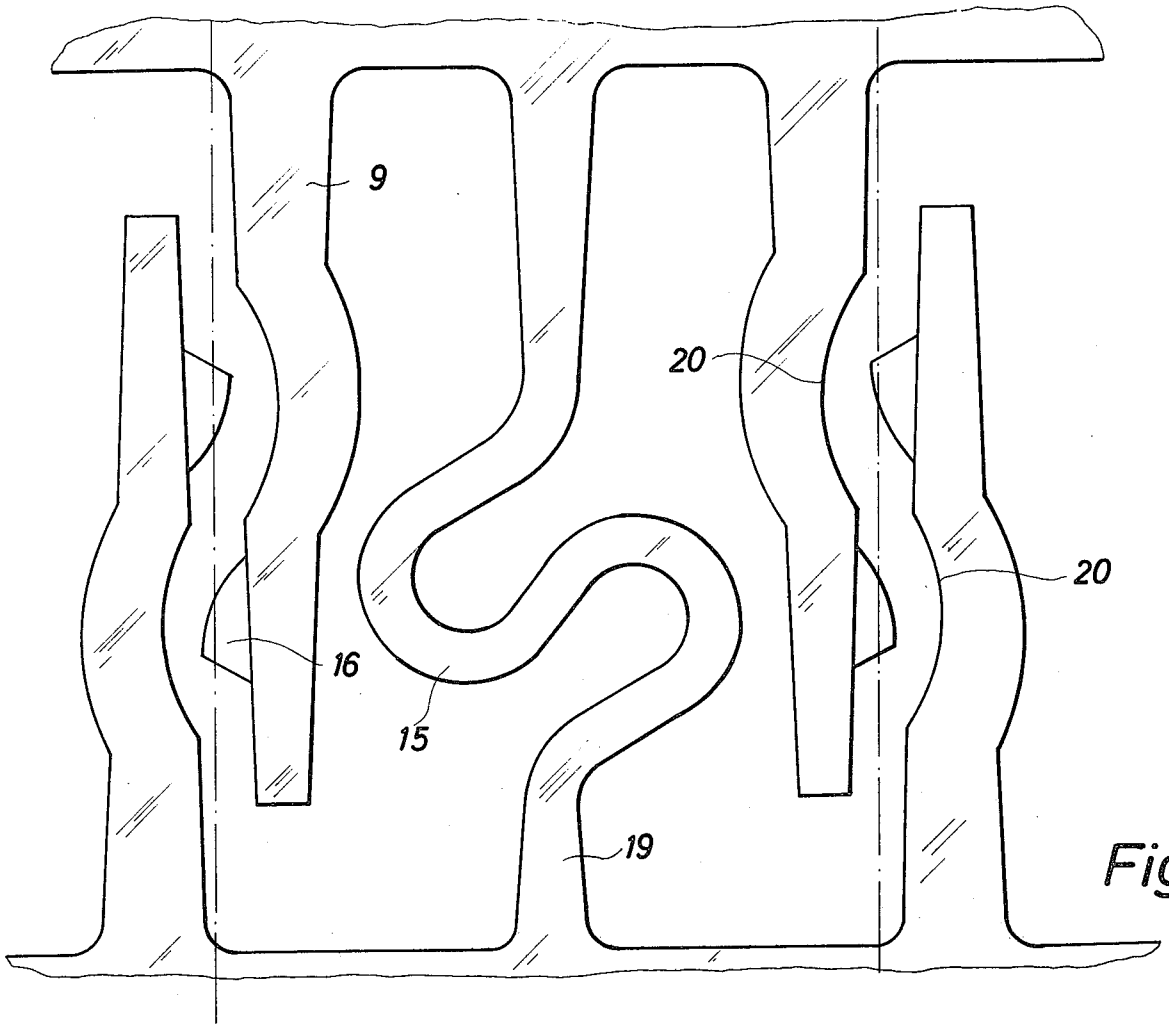
FIG. 7 is a view which illustrates on a larger scale an embodiment of a string.

FIG. 7 illustrates a particularly advantageous embodiment of a tube according to the invention, illustrated in the compressed state, said state corresponding to the shape in which the tube is moulded. In this embodiment an S-shaped string 15 is provided which at both ends extend into a heavier profile 19 extending rectilinearly along a generatrix in the cylinder surface between two rings. Compared to the string illustrated in FIGS. 2 and 3, which in the stretched state is slightly curved and in the compressed state more curved over its entire length, the string illustrated in FIG. 7 possesses the advantage that it is shorter, i.e. its total length is smaller, and that it nevertheless provides the same possibility of extension of the tube. Furthermore, it provides a higher stability and less deformation problems, and it is more resilient and durable seeing that it stands 5 to 10 times as many compressions and straightenings as the string illustrated in FIGS. 2 and 3. In order to ensure room for the knobs 16 in the press tool the arms 9 are provided with recesses 20.

In FIGS. 2 and 3 the tube is shown with springs 11 connecting the rings 2 between each set of arms 9. However, it is, of course, possible to have more or fewer springs, depending on their thicknesses. The decisive fact is that the springs are not to carry the yarn and therefore need not be so thick that the tube is rigid and difficult to straighten after use.

I claim:

1. A tube made of molded plastic material for yarn bobbins of variable axial length, said tube including a plurality of axially spaced apart concentric rings each of which has a plurality of arms extending longitudinally of the tube, said arms having outer sides which together form a cylindrical or slightly conical surface of the tube for receiving yarn bobbins, said including and rings being connected together by resilient spring members molded integrally with said rings and located radially inward of said surface formed by said arms, said spring members being of such dimensions that the tube may be compressed in axial direction by virtue of the resilience of the plastic material and said spring members being stretchable in the axial direction of the tube and when so stretched said spring members extend substantially parallel to the generatrixes in the surface of the tube.

2. A tube as in claim 1 wherein the two rings at the opposite ends of the tube are differently shaped with such profiles that a first end ring presents an outer cylindrical or conical surface and a second ring presents an inner cylindrical or conical surface, said first and second surfaces being adapted to cooperate with second and first complementary surfaces of two adjacent tubes of the same construction so as to hold the tubes together end-to-end.

3. A tube as in claim 1 or 2 wherein said spring members extend rectilinearly between said rings and have a single S-shaped bend.

4. A tube as in claim 1 or 2 wherein the arms, two by two on opposing sides, have knobs projecting beyond the center line between the arms and comprising a surface forming a large angle with the axis of the tube so that they lock the tube in the stretched state when the knobs have passed each other and said surfaces bear against each other.

5. A tube as in claim 1 or 2 which has been molded in a mold corresponding to the shape of the tube in the compressed state.

6. A method of producing a tube as in claim 1 or 2 by molding a plastic material in a mold corresponding to the shape of the tube in the compressed state.

* * * * *